US009688293B2

(12) United States Patent
Ozaki et al.

(10) Patent No.: US 9,688,293 B2
(45) Date of Patent: Jun. 27, 2017

(54) METHOD AND DEVICE FOR STEERING TRUCK OF RAILWAY VEHICLE, AND TRUCK

(75) Inventors: Takuya Ozaki, Tokyo (JP); Kazunori Iwato, Tokyo (JP); Satoshi Kikko, Tokyo (JP); Satoshi Tokunaga, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 221 days.

(21) Appl. No.: 14/352,348

(22) PCT Filed: May 22, 2012

(86) PCT No.: PCT/JP2012/063037

§ 371 (c)(1),
(2), (4) Date: Apr. 17, 2014

(87) PCT Pub. No.: WO2013/061641

PCT Pub. Date: May 2, 2013

(65) Prior Publication Data

US 2014/0261062 A1 Sep. 18, 2014

(30) Foreign Application Priority Data

Oct. 26, 2011 (JP) ..... 2011-235284

(51) Int. Cl.

| | |
|---|---|
| ***B61F 5/38*** | (2006.01) |
| ***B61F 5/44*** | (2006.01) |
| ***B61F 5/46*** | (2006.01) |

(52) U.S. Cl.
CPC ..... *B61F 5/38* (2013.01); *B61F 5/44* (2013.01); *B61F 5/46* (2013.01)

(58) Field of Classification Search
CPC ..... B61F 5/38; B61F 5/44; B61F 5/46
See application file for complete search history.

(56) References Cited

U.S. PATENT DOCUMENTS

| | | | | |
|---|---|---|---|---|
| 4,986,191 | A * | 1/1991 | Ragueneau | B61F 5/44 105/168 |
| 5,555,816 | A * | 9/1996 | Jones | B61F 5/38 105/166 |
| 8,485,109 | B2 * | 7/2013 | Dietmaier | B61F 5/38 105/166 |

(Continued)

FOREIGN PATENT DOCUMENTS

| | | |
|---|---|---|
| JP | 49-32816 | 9/1974 |
| JP | 63-94079 | 6/1988 |

(Continued)

*Primary Examiner* — Zachary Kuhfuss
(74) *Attorney, Agent, or Firm* — Clark & Brody

(57) ABSTRACT

The object is to solve the issue of an over-steered state at an exit straight portion in addition to enhance a curve passage performance than when a steering angle of front and rear axles is set at a radial steering angle. A steering method for a steering device intentionally turns two axles (12*a*, 12*b*) of a truck (12) of a railway vehicle relative to a frame of the truck. The two axles are arranged at front and rear of the truck with respect to a direction of running of the railway vehicle. The steering method includes steering the axles such that a steering angle ($\alpha 1$) of the front axle (12*a*) is larger than a steering angle ($\alpha 2$) of the rear axle (12*b*).

4 Claims, 11 Drawing Sheets

(a)

(b)

(56) References Cited

U.S. PATENT DOCUMENTS

| | | | | |
|---|---|---|---|---|
| 8,511,238 | B2 * | 8/2013 | Kikko | B61F 5/44 105/157.1 |
| 8,833,267 | B2 * | 9/2014 | Six | B61F 5/38 105/165 |
| 2010/0229753 | A1 * | 9/2010 | Kikko | B61F 5/44 105/4.4 |
| 2012/0048139 | A1 * | 3/2012 | Okubo | B61F 5/526 105/182.1 |
| 2013/0019775 | A1 * | 1/2013 | Six | B61F 5/38 105/165 |
| 2016/0023670 | A1 * | 1/2016 | Sato | B61F 5/46 105/182.1 |

FOREIGN PATENT DOCUMENTS

| | | |
|---|---|---|
| JP | 04-300773 | 10/1992 |
| JP | 08-295235 | 11/1996 |
| JP | 09-109886 | 4/1997 |
| JP | 09-226576 | 9/1997 |
| JP | 10-203364 | 8/1998 |
| JP | 2000-272514 | 10/2000 |
| JP | 2008-126811 | 6/2008 |
| WO | 2009/038068 | 3/2009 |
| WO | 2011/120915 | 10/2011 |

* cited by examiner (a)

(b)

(a)

(b)

METHOD AND DEVICE FOR STEERING TRUCK OF RAILWAY VEHICLE, AND TRUCK

TECHNICAL FIELD

The present invention relates to a steering method in which a steering device intentionally turns two axles of a truck of a railway vehicle relative to a frame of the truck, the two axles being arranged in the front and rear of the truck in a direction of running of the railway vehicle, and the steering device that realizes the steering method. The present invention further relates to a truck equipped with the steering device, and more particularly to a linear truck that is powered by a linear induction motor. In the following explanation, the front side, or direction, with respect to the direction of running of the railway vehicle will be simply called "front" or "forward" and the rear side, or direction, with respect to the direction of running of the railway vehicle will be simply called "rear" or "rearward".

BACKGROUND ART

When a railway vehicle runs on a curved track, a steering device of a truck of the railway vehicle turns two axles, arranged in the front and rear of the truck, in a yawing direction. The object of this turning is to reduce a turning resistance (lateral pressure) acting on the wheels attached to the axles.

The steering devices currently in commercial use turn the two axles symmetrically in the front and rear. Moreover, these steering devices set a steering angle of the axles to an angle that is geometrically most ideal (hereinafter, "radial steering angle").

Referring to FIG. 14, assuming a steering angle to be "β", a radius of curvature of the curved track to be "R", and a distance between a center of a truck 2 and a center of axle 3 to be "a", the radial steering angle, which is a steering angle at which the wheels attached to the axles will be in the most ideal steering state when running on the curved track, can be represented by the following Equation 1. In FIG. 14, 1 represents a vehicle body and 4 represents a track.

$$\beta=\sin^{-1}(a/R) \quad \text{[Equation 1]}$$

However, when the truck is running on the curved track, the actual steering angles of the axles are insufficient due to a resistance to turning of the truck and the vehicle body. Therefore, if the steering angle is set at the radial steering angle, the axles do not turn to such an extent that they point to a center of curvature "C" of the curved track.

To address the above issue, Patent Reference 1 proposes a technique of setting the steering angle to an angle that is larger than the radial steering angle. By setting the steering angle at the larger angle, it is possible to compensate for the insufficiency in the steering angle due to resistance in various parts such as resistance between the vehicle body and the truck, resistance within the steering device, and resistance within an axle box support device.

When the set steering angle is larger than the radial steering angle as disclosed in the technique of Patent Reference 1, at the center of the curved track, a lateral pressure from an outer rail on a front axle of a front truck of the railway vehicle reduces. In the following explanation, in a railway vehicle equipped with two trucks, one in the front and the other in the rear of the railway vehicle, each having two sets of axles, the axles will be referred to as a first axle, a second axle, a third axle, and a fourth axle in order from front to rear.

However, even in the technique proposed in Patent Reference 1, the fact remains that the front and rear axles are turned symmetrically. Therefore, when the railway vehicle enters a straight portion at an exit of the curved track (hereinafter, "exit straight portion"), as shown in FIG. 15, the railway vehicle enters in an over-steered posture, whereby the lateral pressure from the inner rail on the first axle increases. In FIG. 15, 2*a* represents the front truck, 2*b* represents a rear truck, 3*a* represents the first axle, 3*b* represents the second axle, 3*c* represents the third axle, 3*d* represents the fourth axle, 4*a* represents the inner rail, and 4*b* represents the outer rail.

PRIOR ART REFERENCES

Patent References

Patent Reference 1: Japanese Patent Application Laid-open No. H10-203364

SUMMARY OF THE INVENTION

Problem to be Solved by the Invention

A problem to be solved by the present invention is, in a steering device that turns the front and rear axles symmetrically, when the steering angle is increased to further improve the performance, the lateral pressure from the inner rail on the first axle disadvantageously increases as the railway vehicle is in an over-steered posture when the railway vehicle enters the exit straight portion.

Means for Solving this Problem

In order to solve the issue of an over-steered state at the exit straight portion in addition to enhancing the curve passage performance than when a steering angle of front and rear axles is set at a radial steering angle, a steering method for a truck of a railway vehicle according to the present invention intentionally turns two axles of the truck relative to a frame of the truck. The two axles are arranged at the front and rear of the truck. Moreover, the steering method includes steering the axles such that a steering angle of an axle at the front is larger than a steering angle of an axle at the rear.

In the steering method for the truck of a railway vehicle according to the present invention, by steering such that the steering angle of the front axle is larger than the steering angle of the rear axle, the posture of the truck is shifted toward an under-steered direction, and the over-steered state at the exit of the curved track is relaxed, leading to suppressing an increase in the lateral pressure from an inner rail. Moreover, the lateral pressure from an outer rail on the front axle is reduced as the front axle is steered by a larger angle.

Advantageous Effects of the Invention

According to the present invention, the curve passage performance enhances by decreasing the lateral pressure from the outer rail on the front axle on the curved track, and an increase in the lateral pressure from the inner rail on the front axle is suppressed by relaxing the over-steered posture at the exit straight portion of the curved track.

EMBODIMENTS OF THE INVENTION

An object of the present invention is to solve the issue of over-steered state at the exit straight portion in addition to enhancing the curve passage performance. This object is achieved by reducing, when a truck is running on the circular track, a lateral pressure from an outer rail on a front axle by steering axles such that a steering angle of the front axle is larger than a steering angle of the rear axle.

Embodiment

Exemplary embodiments for embodying the present invention are explained below with reference to FIGS. 1 to 13.

In a conventional truck equipped with a steering device that symmetrically rotates two axles arranged in the front and rear of the truck, if the steering angle of the axles is set at the radial steering angle when the conventional truck runs on the circular truck (hereinafter, "conventional art"), the actual steering angle becomes insufficient.

On the other hand, if the steering angle is set larger than the radial steering angle in the conventional truck (hereinafter, "technique of Patent Reference 1"), the posture of the truck becomes over-steered at the exit straight portion leading to an increase in the lateral pressure from the inner rail on the front axle and obstructing further enhancement of the performance.

To address the above issue, the inventors considered setting non-symmetric steering angles for the front and rear axles. In the technique disclosed in Japanese Patent Application Laid-open No. 2000-272514, the posture of the truck becomes over-steered when the steering angle of the rear axle is increased. However, the present invention focuses on the problem arising due to the over-steering, which cannot be solved by the technique of increasing the steering angle of the rear axle.

The inventors exploited the fact that different steering reaction forces are generated at the front and rear of the steering device when the steering angle of the front axle is set larger than the steering angle of the rear axle. Concretely, when a steering angle $\alpha_1$ of a front axle 12*a* arranged in a truck 11 is set larger than a steering angle $\alpha_2$ of a rear axle 12*b*, i.e., when $\alpha_1>\alpha_2$ (See, FIG. 1(*a*)), a steering reaction force $F_1$ acting on the front axle 12*a* and a steering reaction force $F_2$ acting on the rear axle 12*b* satisfy an inequality $F_1>F_2$ (See, FIG. 1(*b*)).

Figure 1:
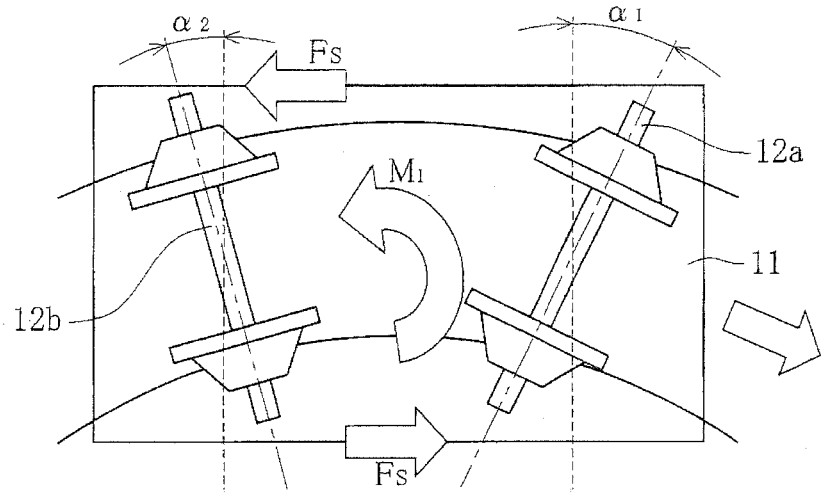
FIG. 1(*a*) is a drawing for explaining a behavior when a steering angle of a front axle is set larger than a steering angle of a rear axle, and FIG. 1(*b*) is a drawing for explaining the steering reaction forces acting on the front and rear axles in the situation shown in FIG. 1(*a*)
Figure 1:
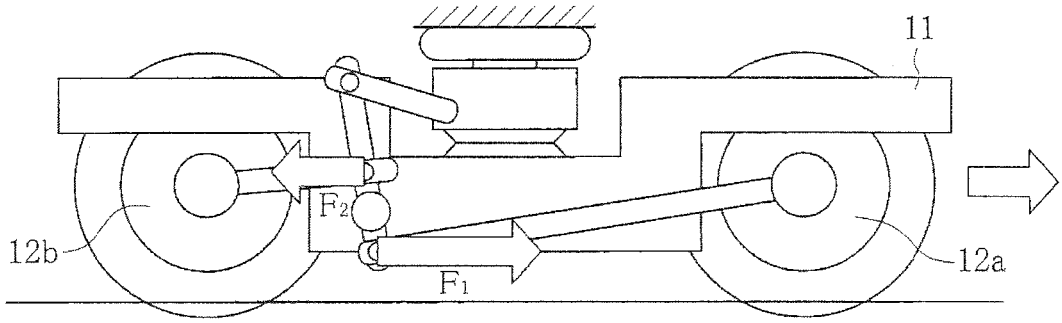

As shown in FIG. 1(*b*), due to an imbalance between the steering reaction forces $F_1$ and $F_2$, a counter force $F_S$ corresponding to a degree of the imbalance is conveyed to the truck 11 (See, FIG. 1(*a*)). This leads to generation of momentum $M_1$, and the posture of the truck 11 that is running on the circular track changes to the under-steered direction. This change in the posture of the truck 11 relaxes the over-steered state of the truck 11 at the exit of the circular track and suppresses the increase in the lateral pressure from the inner rail. Moreover, because the front axle 12*a* is steered by a larger angle, the lateral pressure from the outer rail on the front axle 12*a* is advantageously reduced. The explanation in this paragraph relates to the invention disclosed in Claim 1.

The invention disclosed in Claim 1 is advantageous in that, it is possible to suppress the lateral pressure from the inner rail on the front axle 12*a* when the truck 11 is running on the exit straight portion in addition to reducing the lateral pressure from the outer rail on the front axle 12*a* when the truck 11 is running on the circular track.

A performance of the technique of the conventional art, Patent Reference 1, and the present invention, respectively, were calculated by simulation and then compared with each other.

As a simulation condition, it was assumed that a wheel-type linear vehicle is running on a curved track of a radius R of 100 meters (m) at a speed V of 35 km/hr. The lateral pressure from the outer rail on the front axle at the circular track and the lateral pressure from the inner rail on the front axle at the straight portion at the exit of the circular track were employed as parameters for evaluating the safety.

Figure 2:
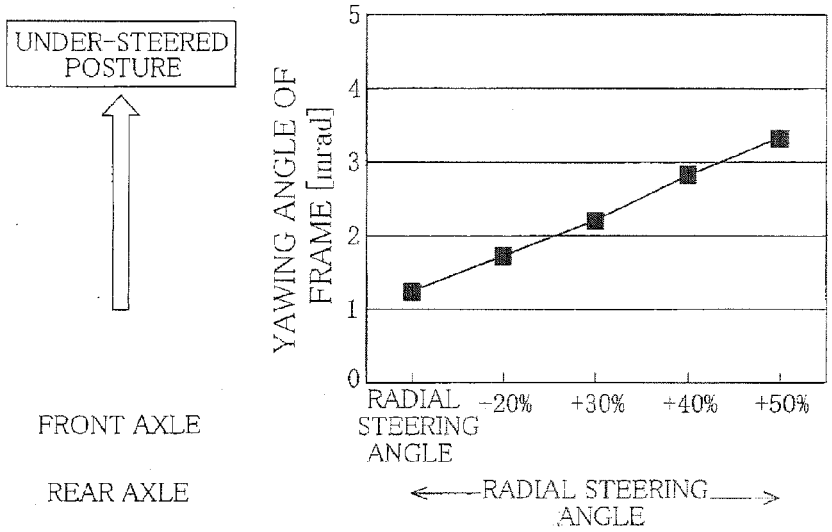
FIG. 2 is a drawing that shows a change in a yawing angle of a frame of a truck running on a circular track when the steering angle of the rear axle is set at a radial steering angle, while the steering angle of the front axle is set at the radial steering angle and at angles that are, respectively, 20%, 30%, 40%, and 50% larger than the radial steering angle.

FIG. 2 is a drawing that shows a change in a yawing angle of a frame that was caused to run on the circular track when, relative to the steering angle of the rear axle that was set at the radial steering angle, the steering angle $\alpha_1$ of the front axle was set at the radial steering angle and at angles that were, respectively, 20%, 30%, 40%, and 50% larger than the radial steering angle. In FIG. 2, the under-steered direction corresponds to the positive direction of the vertical axis.

It is clear from FIG. 2 that, when the steering angle $\alpha_1$ of the front axle is set larger than the steering angle $\alpha_2$ of the rear axle, the yawing angle of the frame increases in a direction that is opposite to the steering direction whereby the degree of under-steered posture of the truck further increases.

This is attributable to, as explained above, generation of the momentum $M_1$ because the counterforce corresponding to the degree of the imbalance between the steering reaction forces is conveyed to the truck (See, FIG. 1). In other words, when the steering angle $\alpha_1$ of the front axle is set larger than the steering angle $\alpha_2$ of the rear axle, only the steering reaction force $F_1$ of the front axle increases leading to an increase in the momentum $M_1$, and the degree of under-steered posture of the truck further increases.

Figure 3:
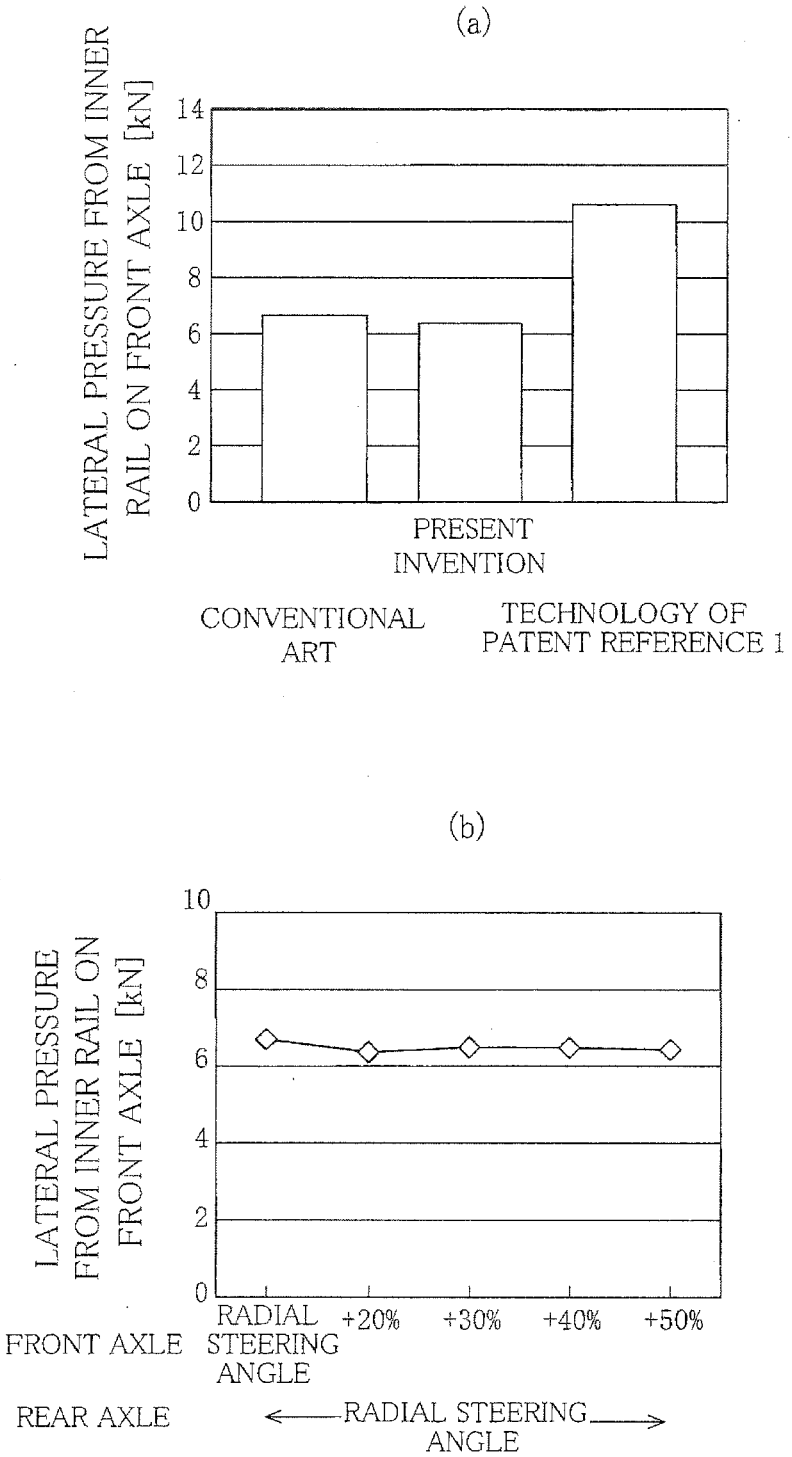
FIG. 3 is a drawing that shows comparison of lateral pressures from an inner rail on the front axle at the exit straight portion in which FIG. 3(*a*) shows comparison of the lateral pressures when the techniques of a conventional art, the present invention, and Patent Reference 1 are respectively applied, and FIG. 3(*b*) shows comparison of the lateral pressures when the steering angle of the rear axle is set at the radial steering angle, while the steering angle of the front axle is set at the radial steering angle and at angles that are, respectively, 20%, 30%, 40%, and 50% larger than the radial steering angle.

In the techniques of the conventional art and Patent Reference 1 in which the front and rear axles are rotated symmetrically, the lateral pressure from the inner rail on the front axle at the exit straight portion increased with an increase in the steering angle (See, "conventional art" and "Patent Reference 1" in FIG. 3(*a*)).

In contrast, in the present invention in which the steering angle $\alpha_1$ of the front axle is set larger than the steering angle $\alpha_2$ of the rear axle, the above-explained change in the posture relaxes the over-steered state at the exit straight portion so that the lateral pressure from the inner rail on the front axle changes little from that in the conventional art (See, "conventional art" and "present invention" in FIG. 3(*a*)). The lateral pressure from the inner rail on the front axle changed little even when the steering angle $\alpha_1$ of the front axle was set at angles that were, respectively, 20%, 30%, 40%, and 50% larger than the radial steering angle (See, FIG. 3(*b*)).

Figure 4:
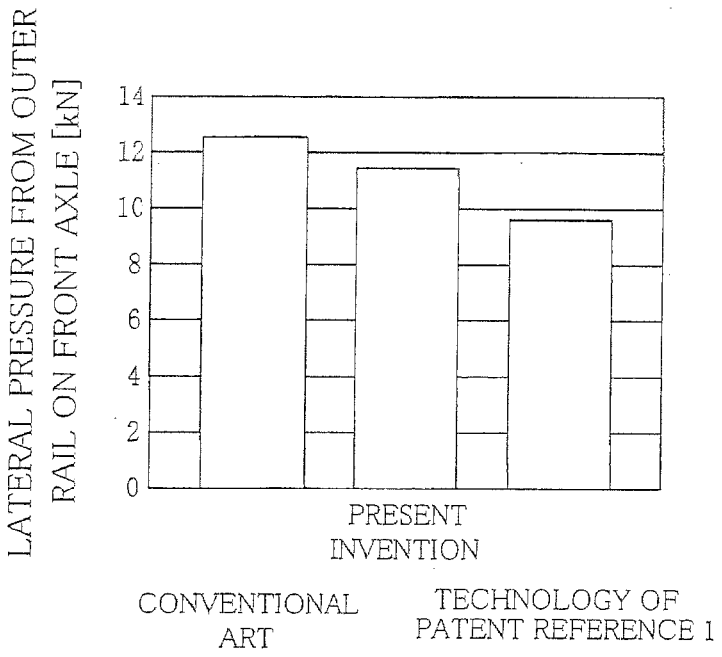
FIG. 4 is a drawing that shows comparison of the lateral pressures from the outer rail on the front axle when the truck is running on the circular track when the techniques of the conventional art, the present invention, and Patent Reference 1 are respectively applied.

On the other hand, although the result given by the technique of the present invention is somewhat inferior to that given by the technique of Patent Reference 1 with respect to the lateral pressure from the outer rail on the front axle when running on the circular track, which is attributable to the steering of the front axle by a larger angle, the lateral pressure from the outer rail on the front axle in the technique of the present invention decreased as compared to the same in the conventional art (See, FIG. 4).

Thus, as explained above, according to the invention disclosed in Claim 1, because the lateral pressure from the inner rail on the front axle at the exit straight portion is suppressed, it is possible to enhance the curve passage performance.

In practical use, it is necessary to take into account that each railway vehicle is supported by two trucks, and the curve passage performance needs to be evaluated by considering the trends of each of the first to fourth axles.

When one railway vehicle is considered, in the technique of Patent Reference 1, the rear truck tends to be in the over-steered posture due to the increased steering angle. Accordingly, an attack angle of the third axle becomes negative leading to insufficient wheel radius difference and low curve passage performance.

In view of the above discussion, the predominance of the present invention with respect to the safety and ease of maintenance will be explained below by taking into account evaluation of the tread wear index (Elkins & Eickoff wear index) of the third axle as well.

When the trucks are arranged such that the steering angle of the first and third axles is larger than the steering angle of the second and fourth axles, the lateral pressure from the outer rail on the first axle at the curved track and the lateral pressure from the inner rail on the first axle at the exit straight portion show similar trends as those explained above, and the same advantageous effect is achieved with respect to the safety. The explanation in this paragraph relates to the invention disclosed in Claim 2.

On the other hand, with respect to a wear index of the third axle, because the steering angle of the first and third axles on the front is set larger than the steering angle of the second and fourth axles on the rear, the over-steered posture of the rear track is also relaxed, and there exists a range in which the wear index as well can be suppressed.

Figure 5:
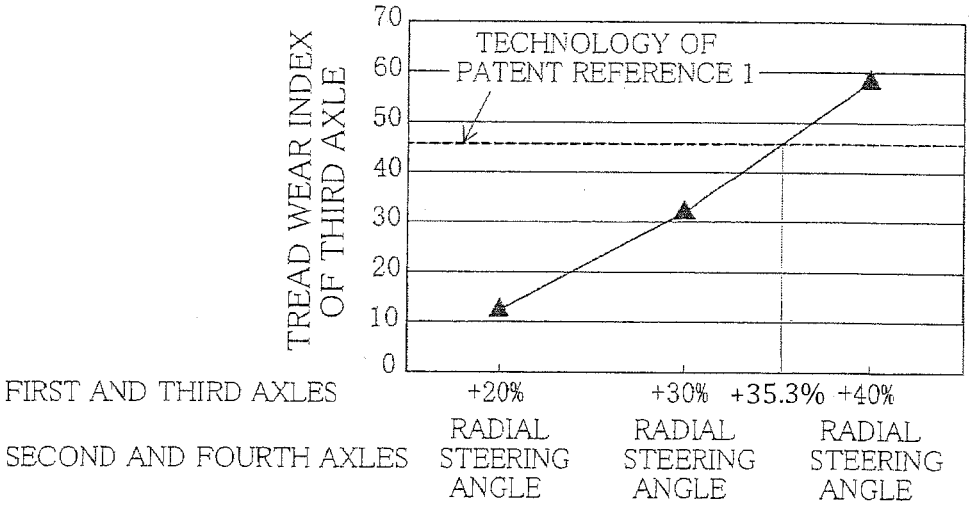
FIG. 5 is a drawing that shows comparison of tread wear indices of a third axle when a steering angle of second and fourth axles on the rear is set at the radial steering angle, while a steering angle of first and third axles on the front is set at angles that are, respectively, 20%, 30%, and 40% larger than the radial steering angle.

FIG. 5 is a drawing that shows the tread wear indices of the third axle when the steering angles of the second and fourth axles on the rear were set at the radial steering angle, while the steering angle of the first and third axles on the front was set at angles that were, respectively, 20%, 30%, and 40% larger than the radial steering angle.

It can be seen from FIG. 5 that, when the steering angle of the second and fourth axles on the rear was set at the radial steering angle, a maximum limit value of an amount of increase from the radial steering angle of the steering angle of the first and third axles on the front is 35.3% and it corresponds to the same tread wear index as in Patent Reference 1.

Figure 6:
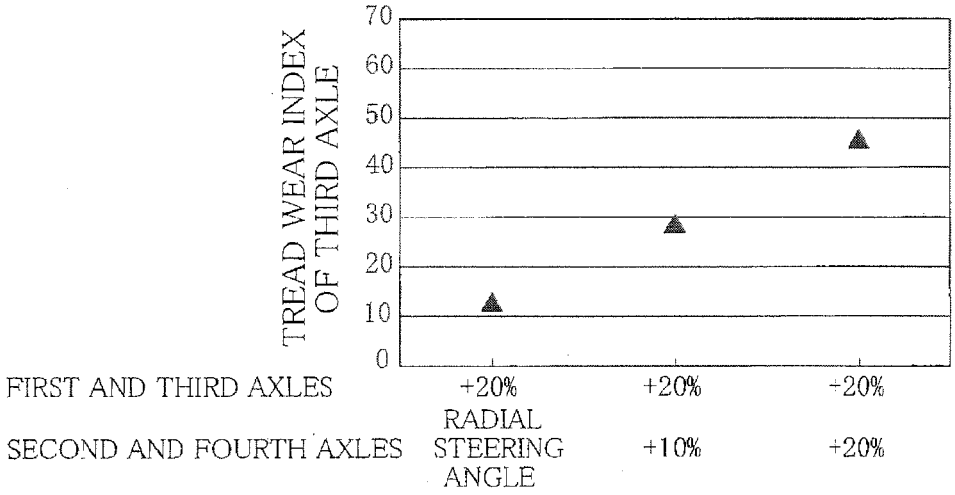
FIG. 6 is a drawing that shows comparison of the tread wear indices of the third axle when the steering angle of the first and third axles on the front is set at an angle that is 20% larger than the radial steering angle, while the steering angle of the second and fourth axles on the rear is set at the radial steering angle and at angles that are, respectively, 10% and 20% larger than the radial steering angle.

FIG. 6 is a drawing that shows comparison of the tread wear indices of the third axle when the steering angle of the first and third axles on the front was set at an angle that is 20% larger than the radial steering angle, while the steering angle of the second and fourth axles on the rear was set at the radial steering angle and at angles that were, respectively 10% and 20% larger than the radial steering angle.

Figure 7:
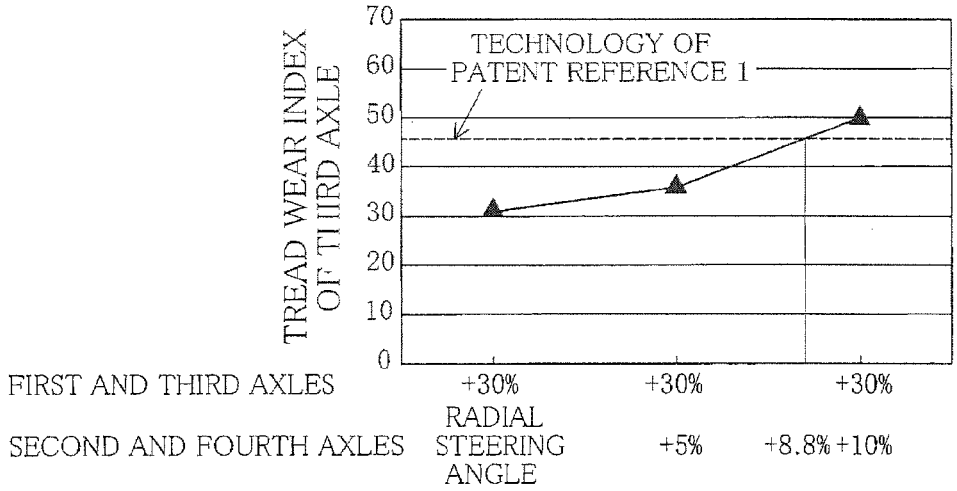
FIG. 7 is a drawing that shows comparison of the tread wear indices of the third axle when the steering angle of the first and third axles on the front is set at an angle that is 30% larger than the radial steering angle, while the steering angle of the second and fourth axles on the rear is set at the radial steering angle and at angles that are, respectively, 5% and 10% larger than the radial steering angle.

FIG. 7 is a drawing that shows comparison of the tread wear indices of the third axle when the steering angle of the first and third axles on the front was set at an angle that is 30% larger than the radial steering angle, while the steering angle of the second and fourth axles on the rear were set at the radial steering angle and at angles that were, respectively 5% and 10% larger than the radial steering angle.

It can be seen from FIG. 7 that, when the steering angle of the first and third axles on the front was set at the angle that is 30% larger than the radial steering angle, a maximum limit value of an amount of increase from the radial steering angle of the steering angle of the second and fourth axles on the rear is 8.8% and it corresponds to the same tread wear index as in Patent Reference 1.

Figure 8:
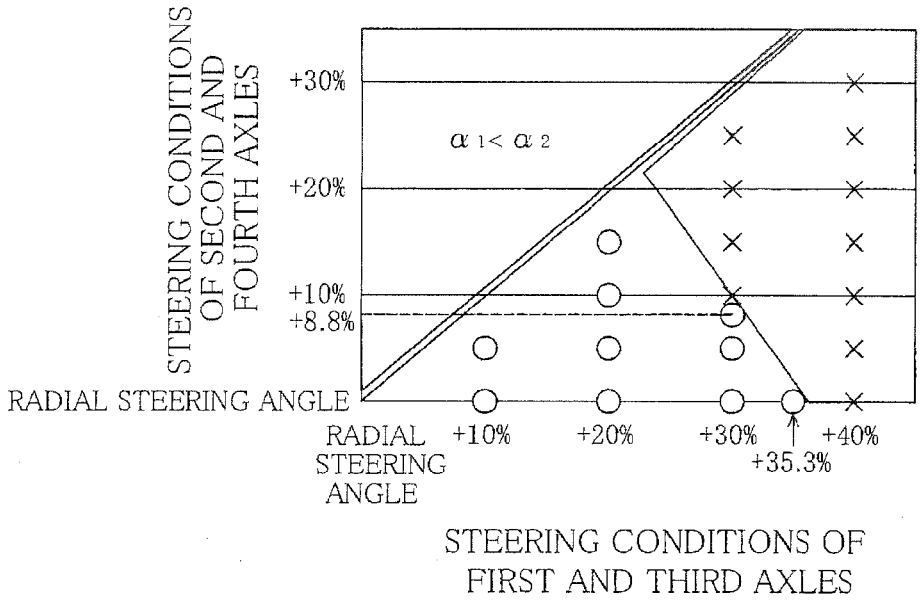
FIG. 8 is a drawing that shows a range in which a remarkable advantageous effect of the present invention is achieved when the steering angle of the first and third axles is set larger than the steering angle of the second and fourth axles.

By using the results shown in FIGS. 5 to 7, with respect to the wear index of the third axle, a limit value that does not exceed the value according to the technique of Patent Reference 1 is calculated, and conditions that showed reduced wear index of the third axle compared to Patent Reference 1 are shown with a circle and conditions that showed increased wear index are shown with a cross in FIG. 8.

When the steering angle $\alpha_1$ of the first and third axles is set larger than the steering angle $\alpha_2$ of the second and fourth axles, a remarkable advantageous effect of the present invention is obtained in a range in which the circles are present in FIG. 8. In other words, a remarkable advantageous effect of the present invention is obtained in a range defined by a straight line that joins a value where, $\alpha_1>\alpha_2$, when the steering angle of the second and fourth axles is larger than the radial steering angle, the steering angle of the first and third axles is 35.3% larger than the radial steering angle when the steering angle of the second and fourth axles is equal to the radial steering angle, and a value where the steering angle of the second and fourth axles is 8.8% larger than the radial steering angle when the steering angle of the first and third axles is 30% larger than the radial steering angle. The explanation in this paragraph relates to the invention disclosed in Claim 3.

It should be noted that the direction of running of a railway vehicle may be sometimes reversed. When the direction of running is reversed, the steering angle of the first and fourth axles can be set larger than the steering angle of the second and third axles. Even in this case, the trends in the lateral pressure from the outer rail on the first axle at the curved track and the lateral pressure from the inner rail on the first axle at the exit straight portion are obtained as before without change, and the tread wear index of the third axle is reduced.

Figure 9:
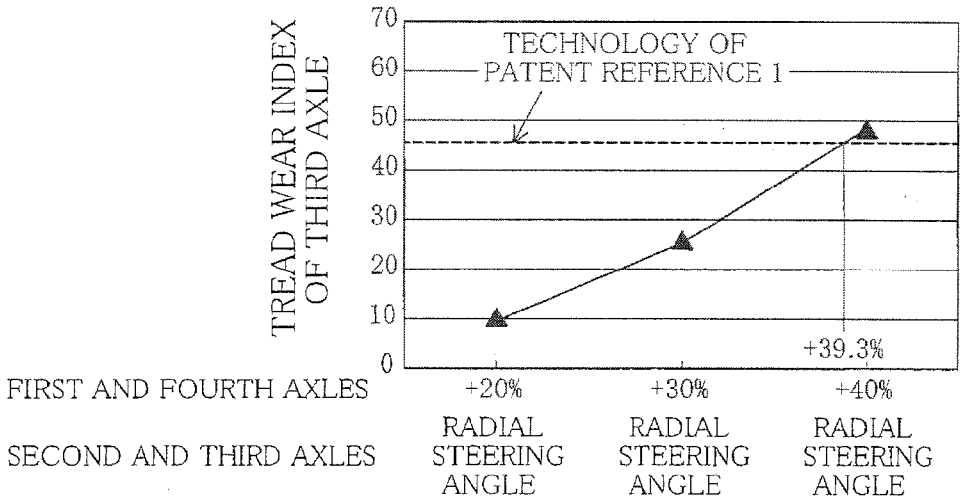
FIG. 9 is a drawing that shows comparison of the tread wear indices of the third axle when the steering angle of the second and third axles is set at the radial steering angle, while the steering angle of the first and fourth axles is set at angles that are, respectively, 20%, 30%, and 40% larger than the radial steering angle.

FIG. 9 is a drawing that shows comparison of the tread wear indices of the third axle when the steering angle of the second and third axles was set at the radial steering angle, while the steering angle of the first and fourth axles was set at angles that were, respectively, 20%, 30%, and 40% larger than the radial steering angle.

It can be seen from FIG. 9 that, when the steering angle of the second and third axles was set at the radial steering angle, a maximum limit value of an amount of increase from the radial steering angle of the steering angle of the first and fourth axles is 39.3% and it corresponds to the same tread wear index as in Patent Reference 1.

Figure 10:
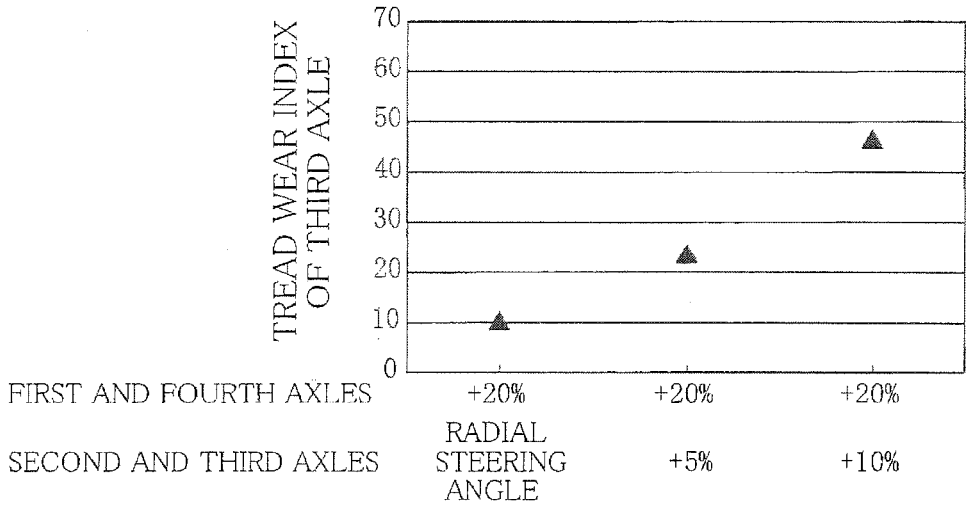
FIG. 10 is a drawing that shows comparison of the tread wear indices of the third axle when the steering angle of the first and fourth axles is set at an angle that is 20% larger than the radial steering angle, while the steering angle of the second and third axles is set at the radial steering angle and at angles that are, respectively, 5% and 10% larger than the radial steering angle.

FIG. 10 is a drawing that shows comparison of the tread wear indices of the third axle when the steering angle of the first and fourth axles was set at an angle that is 20% larger than the radial steering angle, while the steering angle of the second and third axles was set at the radial steering angle and at angles that were, respectively, 5% and 10% larger than the radial steering angle.

Figure 11:
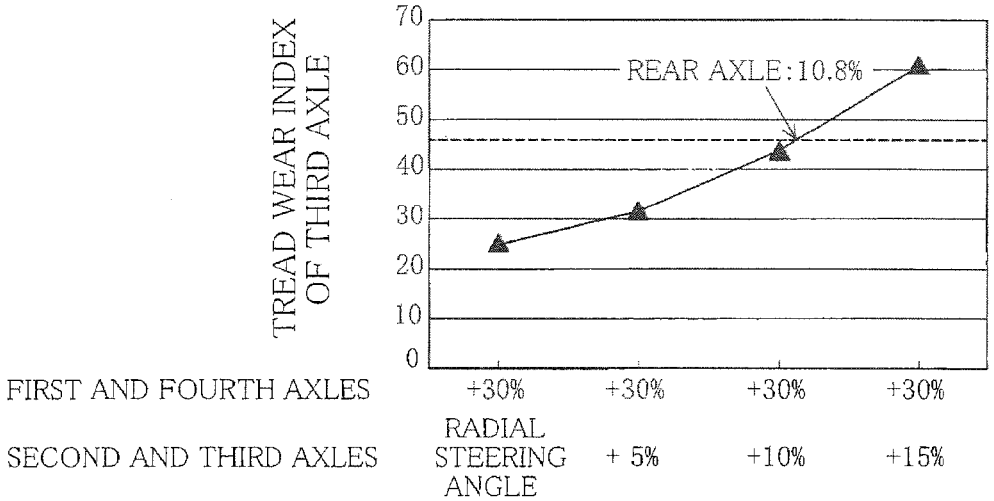
FIG. 11 is a drawing that shows comparison of the tread wear indices of the third axle when the steering angle of the first and fourth axles is set at an angle that is 30% larger than the radial steering angle, while the steering angle of the second and third axles is set at the radial steering angle and at angles that are, respectively, 5%, 10%, and 15% larger than the radial steering angle.

FIG. 11 is a drawing that shows comparison of the tread wear indices of the third axle when the steering angle of the first and fourth axles was set at an angle that is 30% larger than the radial steering angle, while the steering angle of the second and third axles was set at the radial steering angle and at angles that were, respectively, 5%, 10%, and 15% larger than the radial steering angle.

It can be seen from FIG. 11 that, when the steering angle of the first and fourth axles was set at the angle that is 30% larger than the radial steering angle, a maximum limit value of an amount of increase from the radial steering angle of the steering angle of the second and fourth axles is 10.8% and it corresponds to the same tread wear index as in Patent Reference 1.

Figure 12:
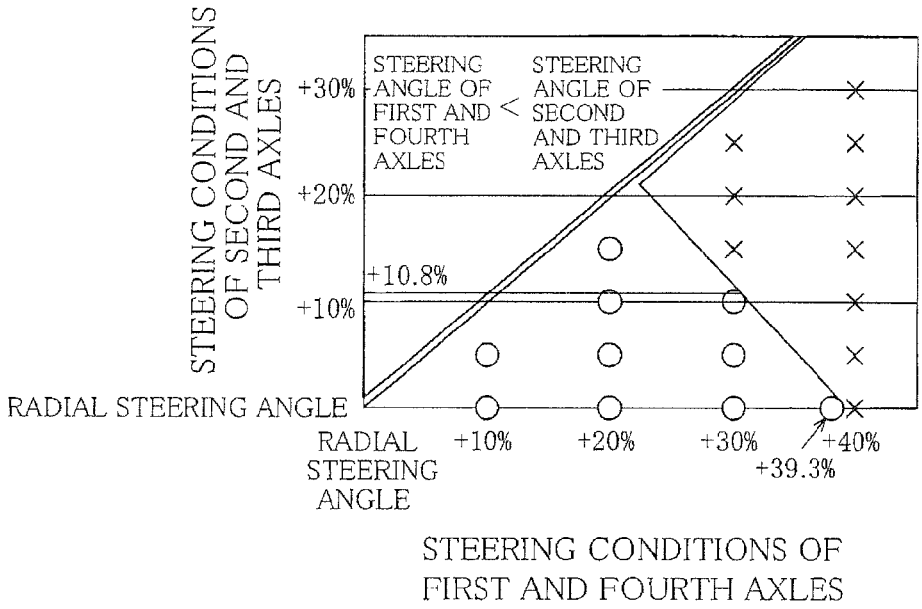
FIG. 12 is a drawing that shows a range in which remarkable advantageous effect of the present invention is achieved when the steering angle of the first and fourth axles is set larger than the steering angle of the second and third axles.

By using the results shown in FIGS. 9 to 11, with respect to the wear index of the third axle, a limit value that does not exceed the value according to the technique of Patent Reference 1 is calculated, and conditions that showed reduced tread wear index of the third axle compared to Patent Reference 1 are shown with a circle and conditions that showed increased tread wear index are shown with a cross in FIG. 12.

When the steering angle of the first and fourth axles is set larger than the steering angle of the second and third axles, remarkable advantageous effect of the present invention is obtained in a range in which the circles are present as shown in FIG. 12. In other words, remarkable advantageous effect of the present invention is obtained in a range defined by a straight line that joins a value where, when the steering angle of the first and fourth axles is larger than the steering angle of the second and third axles and the steering angle of the second and third axles is larger than the radial steering angle, and the steering angle of the first and fourth axles is 39.3% larger than the radial steering angle when the steering angle of the second and third axles is equal to the radial steering angle, and a value where the steering angle of the second and third axles is 10.8% larger than the radial steering angle when the steering angle of the first and fourth axles is 30% larger than the radial steering angle. The explanation in this paragraph relates to the invention disclosed in Claim 4.

It is sufficient that a steering device that realizes the above steering method for a truck of a railway vehicle according to the present invention includes a structure that can set the steering angle of the front axles larger than the steering angle of the rear axles, and there is no specific limitation on rest of the structure of the steering device. However, for example, it may be desirable to employ a steering mechanism shown in FIG. 13 that includes links.

Figure 13:
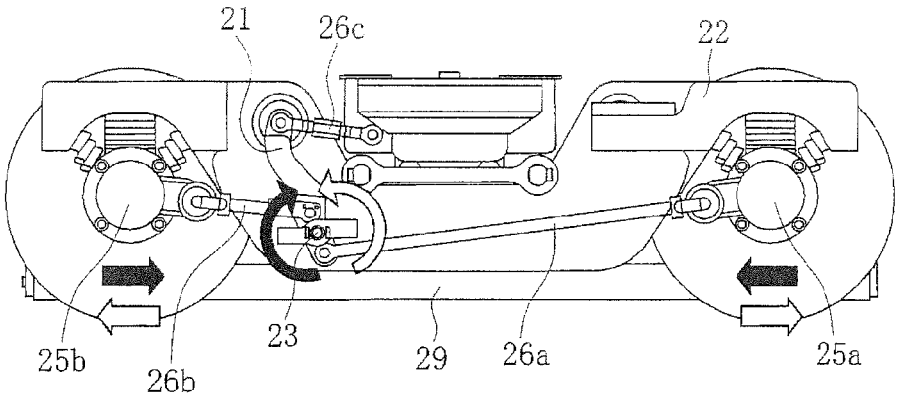
FIG. 13 is a drawing of an exemplary structure of a steering device capable of realizing a steering method according to the present invention in which FIG. 13(*a*) is a side view and FIG. 13(*b*) is a plan view as seen from back of the steering device.
Figure 13:
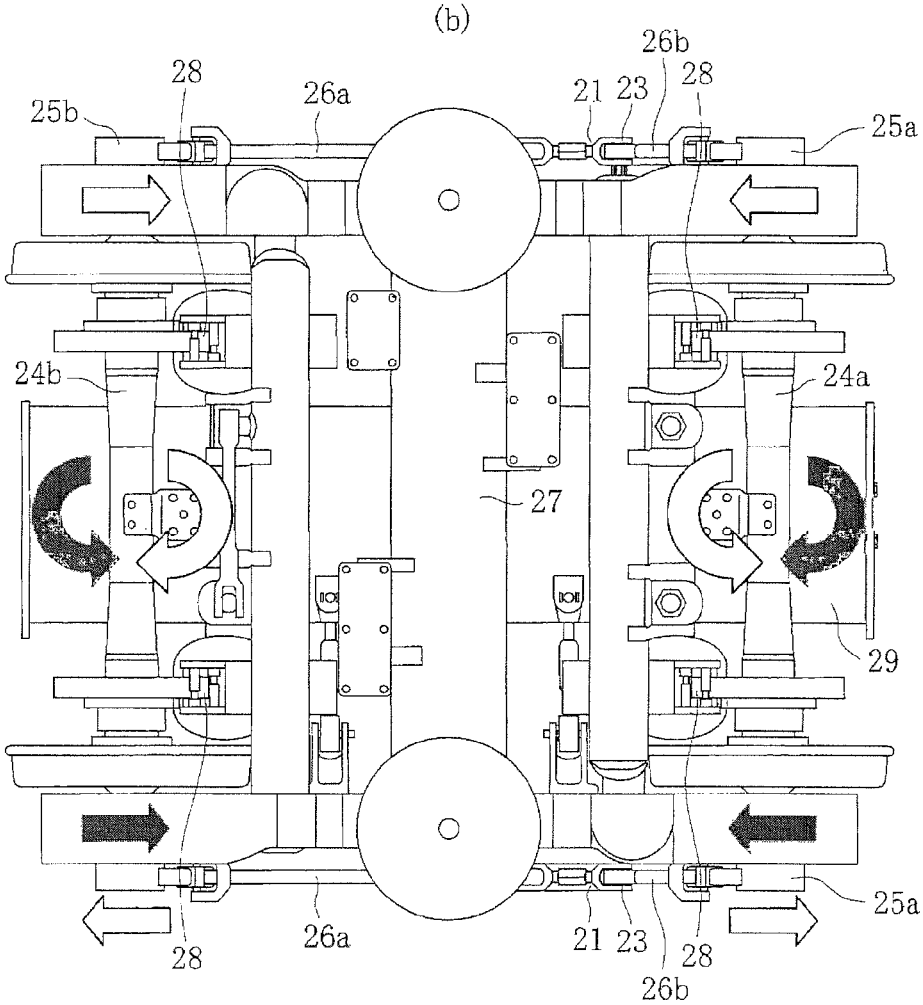
Figure 14:
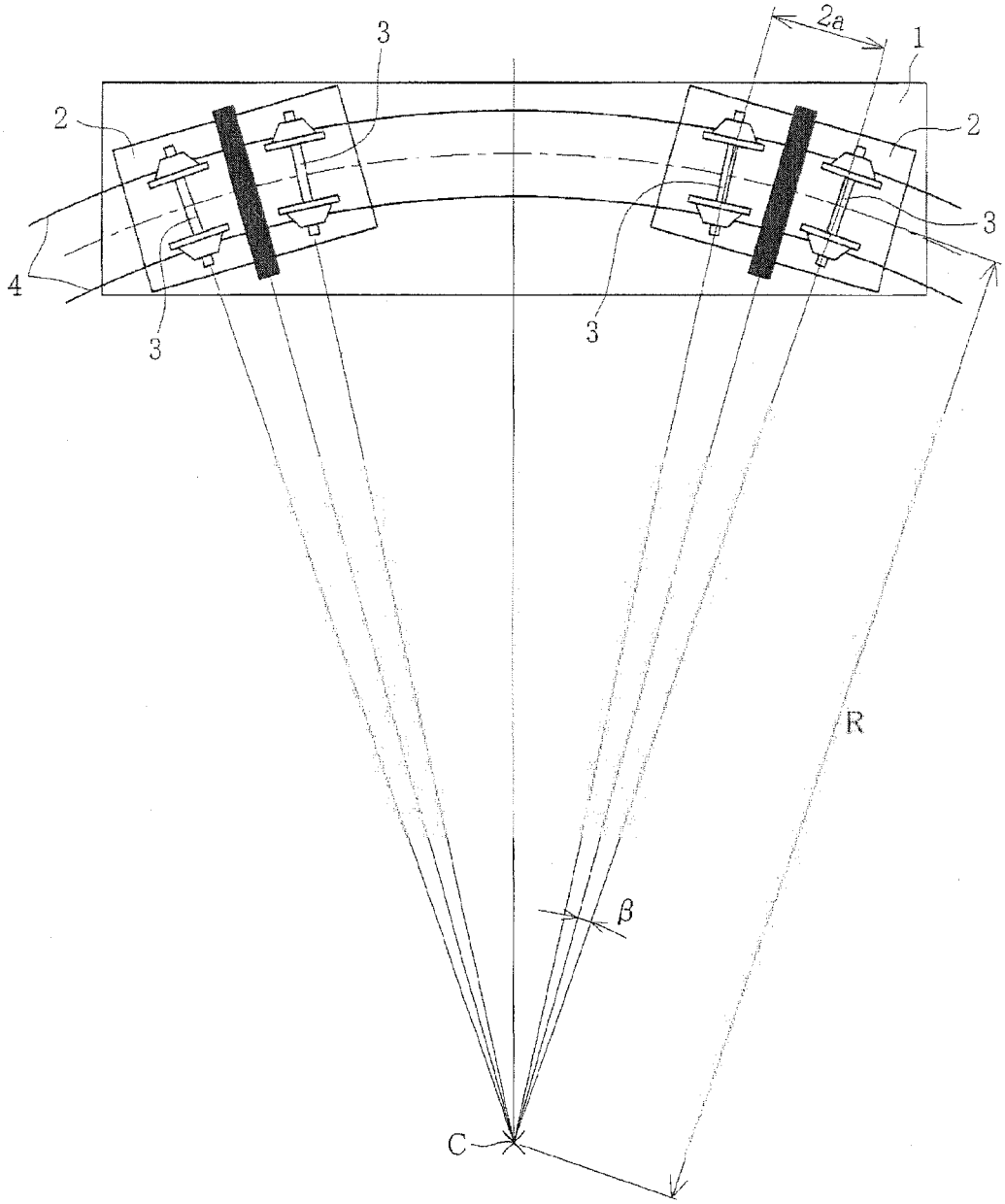
FIG. 14 is a drawing for explaining the concept of the steering angle.
Figure 15:
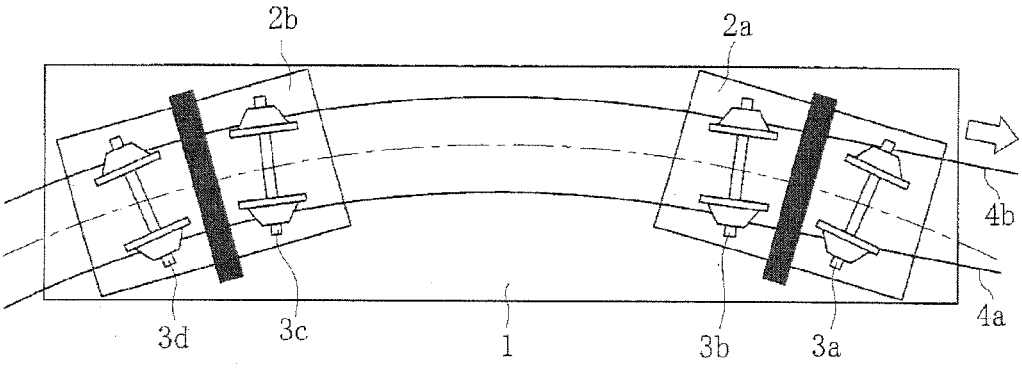
FIG. 15 is a drawing for explaining that, in the technology proposed in Patent Reference 1, when the railway vehicle enters the exit straight portion, the lateral pressure from the inner rail on the first axle increases.

As shown in FIG. 13, 21 represent a lever; and one end of the lever is coupled to the frame 22 in a rotatable manner. Equidistant points with respect to a fulcrum 23 of the lever 21 are rotatably coupled to respective axle boxes 25*a* and 25*b* of front and rear axles 24*a* and 24*b* via first links 26*a* and 26*b*. Moreover, the other end of the lever 21 is rotatably coupled to a bolster 27 via a second link 26*c*.

In this steering mechanism according to the present invention, when running on a curved track, the second link 26*c* rotates due to the rotation of the bolster 27 with respect to the frame 22 causing the lever 21 to rotate around the fulcrum 23. Because of such rotation of the lever 21 around the fulcrum 23, the front and rear axles 24*a* and 24*b* are steered by a certain steering angle via the first links 26*a* and 26*b* and the axle boxes 25*a* and 25*b*.

In a truck of a railway vehicle that employs a motor as a power source and includes the steering device according to the present invention, when steering is performed in a manner shown by solid arrows in FIG. 13, it is difficult for gear devices and unit brakes to respond to the rotation of the axles.

Accordingly, it is desirable to use as a truck of a railway vehicle that includes the steering device according to the present invention, a truck shown in FIG. 13 that is used for linear vehicles rather than an ordinary truck that employs a motor as a power source. The reason behind this is that, the steering device can be easily installed on such a truck because the truck has no gear devices, the truck has disk brakes 28, and the truck is powered by a linear induction motor 29.

It is needless to say that the present invention is not limited to the above explained structure and the embodiments can be changed appropriately within the scope of the technical idea disclosed in the Claims.

DESCRIPTION OF REFERENCE NUMERALS

11 Truck
12*a* Front axle
12*b* Rear axle
21 Lever
22 Frame
23 Fulcrum
24*a*, 24*b* Axle
26*a*, 26*b* First link
26*c* Second link

The invention claimed is:

1. A steering method for a steering device that intentionally turns two axles of each of two trucks of a railway vehicle relative to a frame of the respective trucks, the two trucks being arranged in front and rear of the railway vehicle with respect to a direction of running of the railway vehicle, the two axles being arranged in front and rear of each of the trucks with respect to the direction of running, the steering method for a truck of a railway vehicle, wherein in a coordinate system where a percentage of a steering angle larger than the steering angle of first and fourth axles is set as the lateral axis, a percentage of a steering angle larger than the steering angle of second and third axles is set as the longitudinal axis, and a radial steering angle is set as the original point, the steering angle of the first and fourth axles is larger than the steering angle of the second and third axles, and the steering angle of the second and third axles is equal to or larger than the radial steering angle, and wherein the steering includes:

steering the first and fourth axles and the second and third axles at a steering angle which is smaller than a steering angle on a straight line that joins:

(a) a coordinate, lateral axis=393, longitudinal axis=0, where the steering angle of the first and fourth axles is 393% larger than the radial steering angle when the steering angle of the second and third axles is equal to the radial steering angle; and (b) a coordinate, lateral axis=30, longitudinal axis=10.8, where the steering angle of the second and third axles is 10.8% larger than the radial steering angle when the steering angle of the first and fourth axles is 30% larger than the radial steering angle;

wherein the steering is performed when the two trucks are moving in both the running direction and an opposite direction of the running direction.

2. A steering device for a truck of a railway vehicle that realizes the steering method according to claim 1 includes a steering mechanism equipped with a link.

3. A truck for use in a railway vehicle comprising the steering device according to claim 2.

4. A linear truck for use in a railway vehicle comprising the steering device according to claim 2.

* * * * *